US010428830B2

(12) United States Patent
Lee et al.

(10) Patent No.: US 10,428,830 B2
(45) Date of Patent: Oct. 1, 2019

(54) FAN AND IMPELLER THEREOF

(75) Inventors: Chin-Hung Lee, Taoyuan Hsien (TW); Tsung-Yin Lee, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 1466 days.

(21) Appl. No.: 13/310,462

(22) Filed: Dec. 2, 2011

(65) Prior Publication Data

US 2012/0171043 A1 Jul. 5, 2012

(30) Foreign Application Priority Data

Dec. 29, 2010 (TW) ..... 099146639

(51) Int. Cl.
*F04D 29/38* (2006.01)
*F04D 29/16* (2006.01)

(52) U.S. Cl.
CPC ..... *F04D 29/384* (2013.01); *F04D 29/164* (2013.01); *F05D 2240/307* (2013.01)

(58) Field of Classification Search
CPC .... F04D 19/002; F04D 29/164; F04D 29/324; F04D 29/384; F05D 2240/307
USPC .... 416/228, 234, 235, 241 A, 241 R, 210 R, 416/211, 236 R
See application file for complete search history.

(56) References Cited

U.S. PATENT DOCUMENTS

| | | | | |
|---|---|---|---|---|
| 6,458,598 | B1 * | 10/2002 | Huang | 436/176 |
| 6,648,598 | B2 * | 11/2003 | Mimura | 415/220 |
| 6,761,539 | B2 * | 7/2004 | Cipelletti et al. | 416/228 |
| 7,438,522 | B2 * | 10/2008 | Eimer | 415/173.6 |
| 7,559,744 | B2 * | 7/2009 | Suzuki et al. | 416/169 A |
| 8,512,004 | B2 * | 8/2013 | Nakagawa et al. | 416/228 |
| 2004/0136830 | A1 * | 7/2004 | Eguchi et al. | 416/228 |
| 2004/0253103 | A1 * | 12/2004 | Iwase et al. | 415/220 |

FOREIGN PATENT DOCUMENTS

| | | | | |
|---|---|---|---|---|
| CN | 102536898 | A * | 7/2012 | |
| EP | 168594 | A * | 1/1986 | |
| GB | 946794 | A * | 1/1964 | |
| GB | 2050530 | A * | 1/1981 | |
| GB | 2452104 | A * | 2/2009 | |
| KR | 20020066684 | A * | 8/2002 | |
| KR | 100421884 | B1 * | 3/2004 | F04D 19/00 |
| TW | M389174 | | 9/2010 | |

* cited by examiner

*Primary Examiner* — Ninh H. Nguyen
*Assistant Examiner* — Jesse M Prager
(74) *Attorney, Agent, or Firm* — Kirton McConkie; Evan R. Witt

(57) ABSTRACT

An impeller includes a hub and a plurality of blades. The blades are connected with the hub. Each blade includes a base part connected with the hub and a tip part opposed to the base part. The thickness of the tip part of the blade is greater than that of the base part of the blade. In addition, an airflow-guiding part is disposed at the tip part of the blade.

21 Claims, 10 Drawing Sheets

FAN AND IMPELLER THEREOF

FIELD OF THE INVENTION

The present invention relates to an impeller, and more particularly to an impeller with reduced airflow leakage. The present invention also relates to a fan having such an impeller.

BACKGROUND OF THE INVENTION

With increasing development of science and technology, a variety of electronic devices are developed toward minimization, high integration and high power. During operation of an electronic device, a great deal of heat is generated by the electronic components of the electronic device. If the heat fails to be effectively dissipated away, the elevated operating temperature may result in damage, short circuit or deteriorated performance of the electronic device. For effectively removing the heat, a heat-dissipating device is usually installed within or beside the electronic device to exhaust the heat to the surroundings. Moreover, it is critical to increase the efficiency of the heat-dissipating device.

A fan is one of the most common heat-dissipating devices. FIG. 1A is a schematic perspective view illustrating a conventional fan. As shown in FIG. 1A, the fan 1 includes a frame 11, a hub 12 and a plurality of blades 13. The hub 12 is disposed within the frame 11. The blades 13 are arranged around the hub 12 and connected with the hub 12. In addition, a motor (not shown) is installed within hub 12. As the hub 12 is driven to rotate by the motor, the blades 13 arranged around the hub 12 are synchronously rotated to produce airflow to dissipate heat.

The hub 12 and the blades 13 are also collectively referred as an impeller. FIG. 1B is a schematic view illustrating an impeller of the fan of FIG. 1A and the airflow direction, in which there is no back pressure. Please refer to FIGS. 1A and 1B. Since the blade 13 is inclined against the rotating direction of the fan 1, a clearance gap 11*a* is formed between the tip part 130 of the blade 13 and the inner wall of the frame 11. In a case that there is no back pressure (i.e. free flow), the airflow will be directed from a pressure side 131 of the blade 13 to a suction side 132 of the blade 13 through the clearance gap 11*a* (i.e. in the direction indicated as the arrow A). In such way, the local pressure may be lost and a pressure fluctuation at the suction side 132 of the blade 13 may occur. Under this circumstance, since the airflow fluctuates upwardly and downwardly in the clearance gap 11*a*, the wideband or narrowband noise of the fan 1 is increased, the amount of airflow inhaled by the fan 1 is reduced, and the performance of the fan 1 is impaired.

FIG. 1C is a schematic view illustrating an impeller of the fan of FIG. 1A and the airflow direction, in which there is a back pressure. Due to the back pressure, the pressure acting on the pressure side 131 of the blade 13 is increased. That is, the airflow leaks out through the clearance gap 11*a* more easily. The leaked airflow may result in vortex on the suction side 132 of the blade 13 (in the direction indicated as the arrow B). Under this circumstance, the pressure fluctuation of the flow field on the suction side 132 of the blade 13 becomes more serious, the output static pressure of the fan 1 is reduced, and the efficiency of the fan 1 is impaired.

Generally, as the clearance gap 11*a* between the fan 11 and the blade 13 is decreased, the possibility of causing turbulent flow is reduced and the efficiency of the fan 1 is increased. However, when the material strength limitation and the deformation extent of the fan 1 are taken into consideration, the size of the clearance gap 11*a* is positively related to the dimension of the fan 1. That is, the size of the clearance gap 11*a* fails to be arbitrarily reduced. If no proper measure is taken to reduce the airflow leakage, the output pressure of the fan 1 is reduced. Under this circumstance, the performance is impaired, the efficiency is reduced, and the noise is increased.

SUMMARY OF THE INVENTION

The present invention provides a fan and an impeller for increasing the heat-dissipating efficiency, reducing the noise and minimizing the airflow leakage problem.

In accordance with an aspect of the present invention, there is provided an impeller of a fan. The impeller includes a hub and a plurality of blades. The blades are connected with the hub. Each blade includes a base part connected with the hub and a tip part opposed to the base part. The thickness of the tip part of the blade is greater than that of the base part of the blade. In addition, an airflow-guiding part is disposed at the tip part of the blade.

In accordance with another aspect of the present invention, there is provided a fan. The fan includes a frame and an impeller. The impeller is installed within the frame, and includes a hub and a plurality of blades. The blades are connected with the hub. Each blade includes a base part connected with the hub and a tip part opposed to the base part. The thickness of the tip part of the blade is greater than that of the base part of the blade. In addition, an airflow-guiding part is disposed at the tip part of the blade.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 2B:
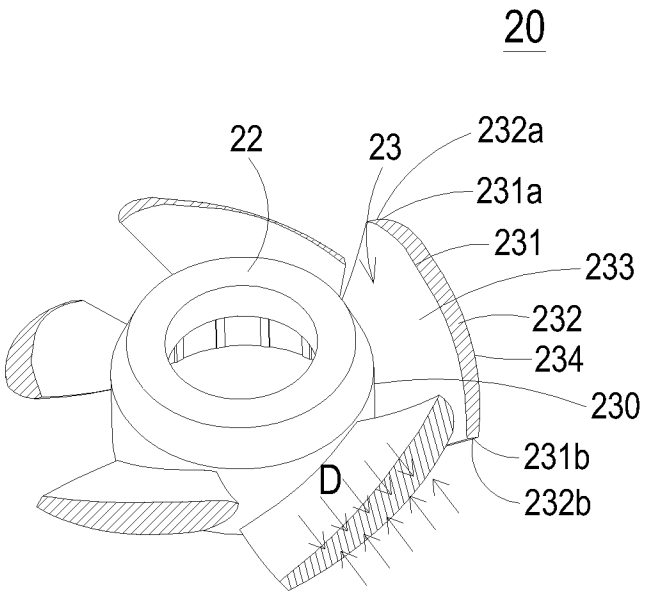
FIG. 2B is a schematic view illustrating an impeller of the fan of FIG. 2A and the airflow direction, in which there is no back pressure.
Figure 2A:
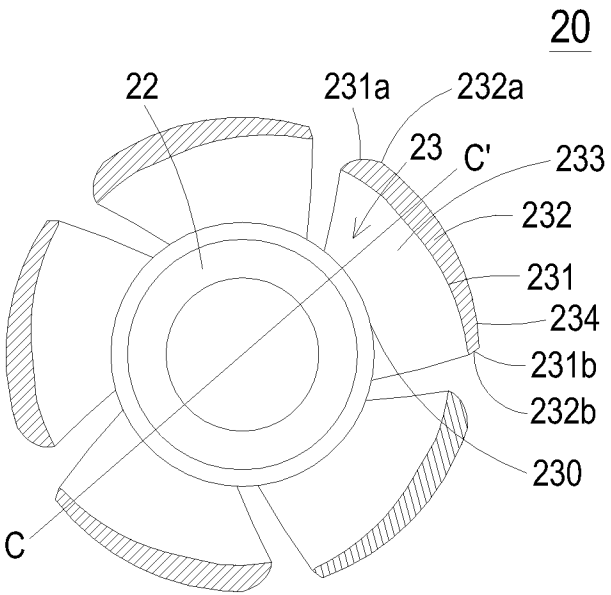
FIG. 2A is a schematic top view illustrating an impeller of a fan according to a first embodiment of the present invention.

FIG. 2A is a schematic top view illustrating an impeller of a fan according to a first embodiment of the present invention. As shown in FIG. 2A, the impeller 20 includes a hub 22 and a plurality of blades 23. A motor (not shown) is installed within the hub 22 for providing motive power required for operations of the fan. The blades 23 are arranged around the hub 22 and connected with the hub 22. As the hub 22 is driven to rotate by the motor, the blades 23 are synchronously rotated to produce airflow.

Figure 2D:
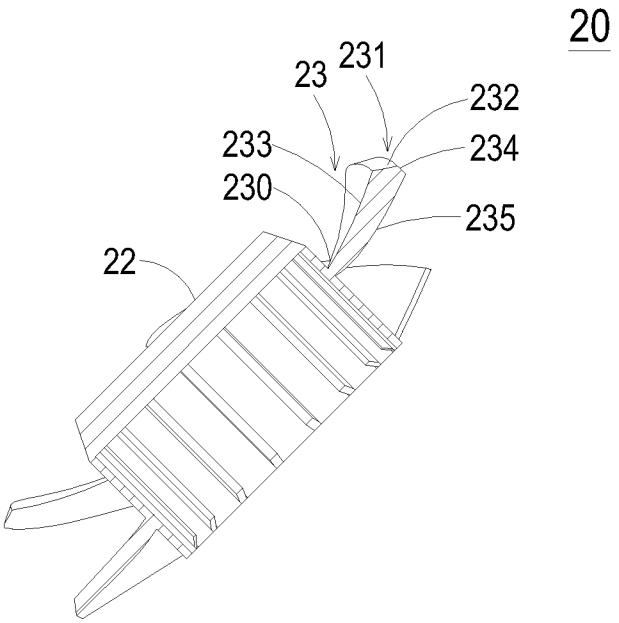
FIG. 2D is a schematic cross-sectional view illustrating the impeller of FIG. 2A and taken along the line CC'.

The blade 23 includes a first curvy surface 233, a second curvy surface 235 (as shown in FIG. 2D), a base part 230 and a tip part 231. The base part 230 and the tip part 231 are arranged at opposed sides of the blade 23. The base part 230 is connected with the hub 22. From the base part 230 to the tip part 231, the thickness of the blade 23 is gradually increased. In an embodiment, the thickness of the tip part 231 is at least 1.5 times as large as the thickness of the base part 230.

FIG. 2D is a schematic cross-sectional view illustrating the impeller of FIG. 2A and taken along the line CC'. Please refer to FIGS. 2A and 2D. As shown in FIG. 2A, the tip part 231 has a front end 231*a*, and a rear end 231*b*. In addition, an airflow-guiding part 232 and an edge surface 234 are disposed at the tip part 231. In this embodiment, the airflow-guiding part 232 has a chamfered surface extended backwardly from the front end 231*a* to the rear end 231*b* of the tip part 231. As shown in FIG. 2D, the chamfered surface of the airflow-guiding part 232 is arranged beside the edge surface 234 and the first curvy surface 233. In addition, the chamfered surface is arranged between the edge surface 234 and the first curvy surface 233.

In some embodiments, the edge surface 234 and the first curvy surface 233 are perpendicular to each other. In some embodiments, the chamfered surface of the airflow-guiding part 232 has a flat profile, a curvy profile or an arc-shaped profile. In addition, the airflow-guiding part 232 has a front guide terminal 232*a* and a rear guide terminal 232*b*. The front guide terminal 232*a* is a start point of the chamfered surface. The rear guide terminal 232*b* is a terminal point of the chamfered surface.

FIG. 2B is a schematic view illustrating an impeller of the fan of FIG. 2A and the airflow direction, in which there is no back pressure. Please refer to FIGS. 2A and 2B. The airflow-guiding part 232 has a chamfered surface extended backwardly from the front end 231*a* to the rear end 231*b* of the tip part 231. That is, the front guide terminal 232*a* of the airflow-guiding part 232 is overlapped with the front end 231*a* of the tip part 231, and the rear guide terminal 232*b* of the airflow-guiding part 232 is overlapped with the rear end 231*b* of the tip part 231. In a case that there is no back pressure, the lateral airflow on the first curvy surface 233 of the blade 23 can be guided to the tip part 231 by the airflow-guiding part 232, and the airflow leaked from the second curvy surface 235 can be stopped by the airflow-guiding part 232 (i.e. in the direction indicated as the arrow D). Since the output static pressure of the fan is not considerably reduced, the efficiency of the fan is enhanced and the noise is reduced.

Figure 2C:
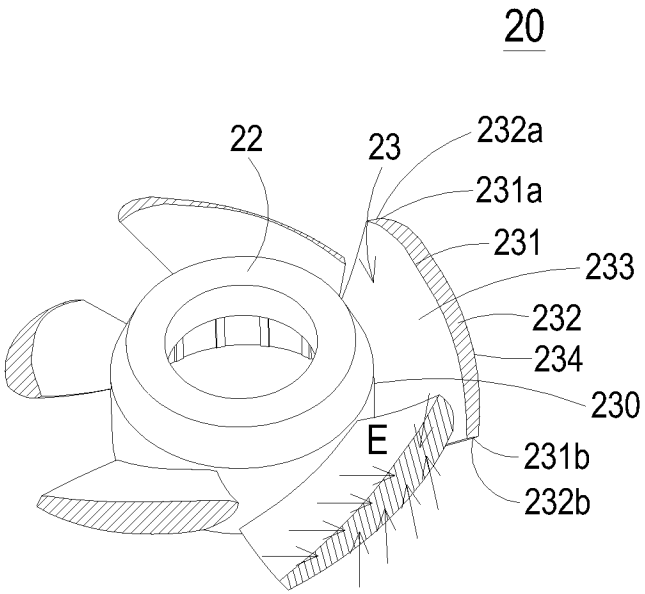
FIG. 2C is a schematic view illustrating an impeller of the fan of FIG. 2A and the airflow direction, in which there is a back pressure.

FIG. 2C is a schematic view illustrating an impeller of the fan of FIG. 2A and the airflow direction, in which there is a back pressure. In a case that a back pressure is exerted on the impeller 20, the lateral airflow on the first curvy surface 233 of the blade 23 can also be guided to the tip part 231 by the airflow-guiding part 232, and the airflow leaked from the second curvy surface 235 can be stopped by the airflow-guiding part 232 (i.e. in the direction indicated as the arrow E). In comparison with the conventional impeller, since the airflow-guiding part 232 is helpful for obliquely guiding the airflow, the possibility of producing vortex will be minimized. Under this circumstance, since the pressure fluctuation at the second curvy surface 235 of the blade 23 is reduced, the efficiency of the fan is enhanced and the noise is reduced.

Figure 1A:
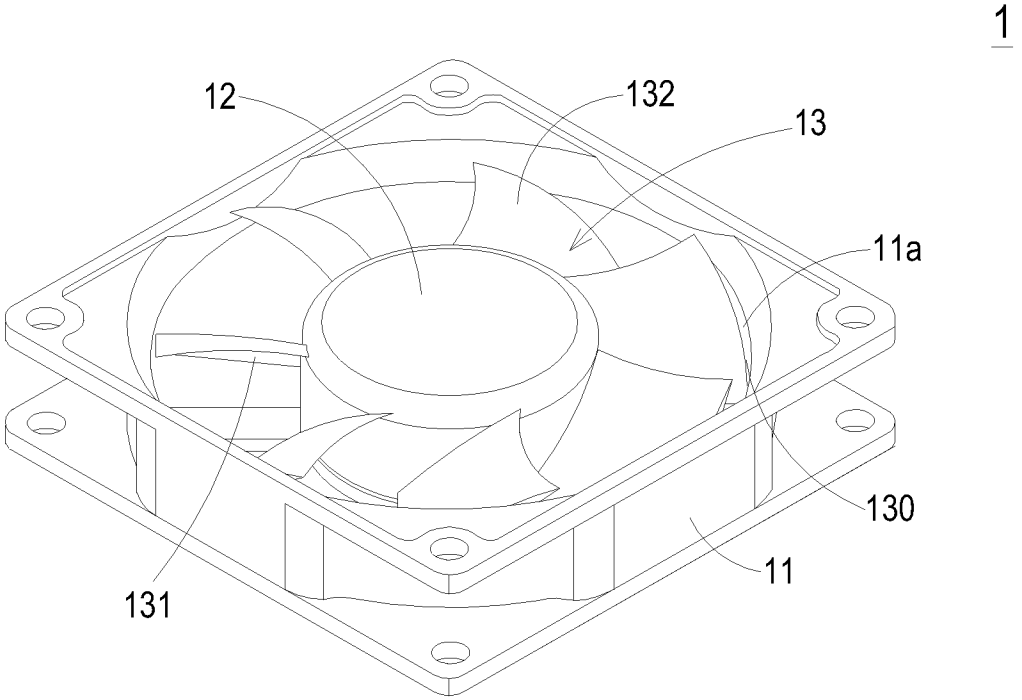
FIG. 1A PRIOR ART
FIG. 1A is a schematic perspective view illustrating a conventional fan.
Figure 1B:
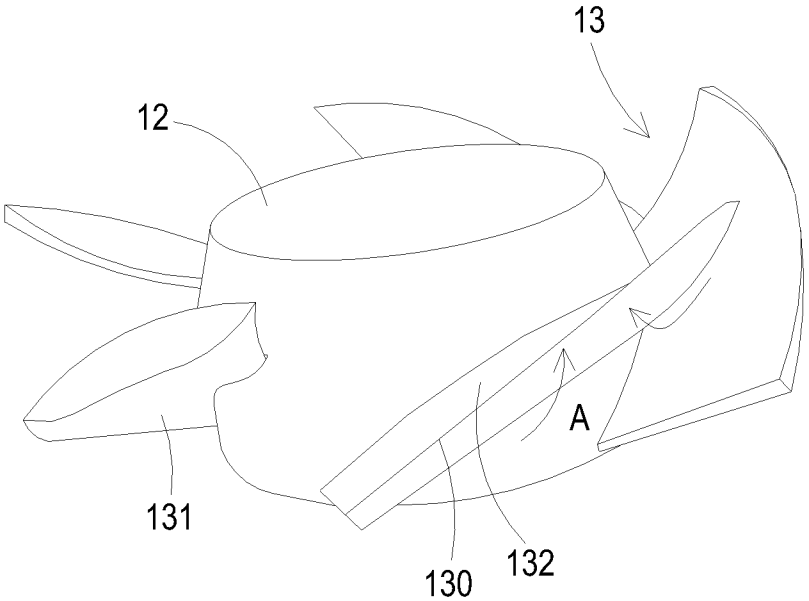
FIG. 1B PRIOR ART
FIG. 1B is a schematic view illustrating an impeller of the fan of FIG. 1A and the airflow direction, in which there is no back pressure.
Figure 1C:
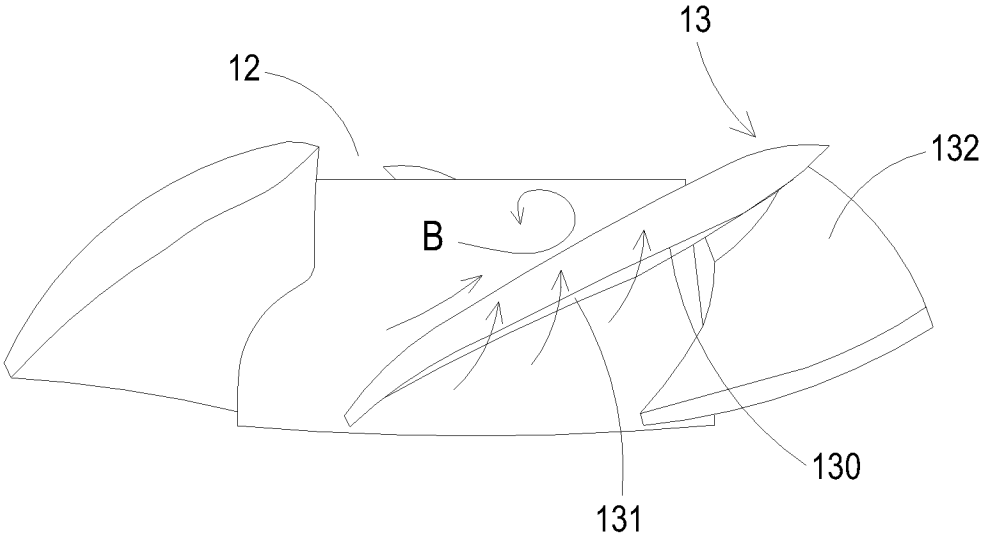
FIG. 1C PRIOR ART
FIG. 1C is a schematic view illustrating an impeller of the fan of FIG. 1A and the airflow direction, in which there is a back pressure.
Figure 3A:
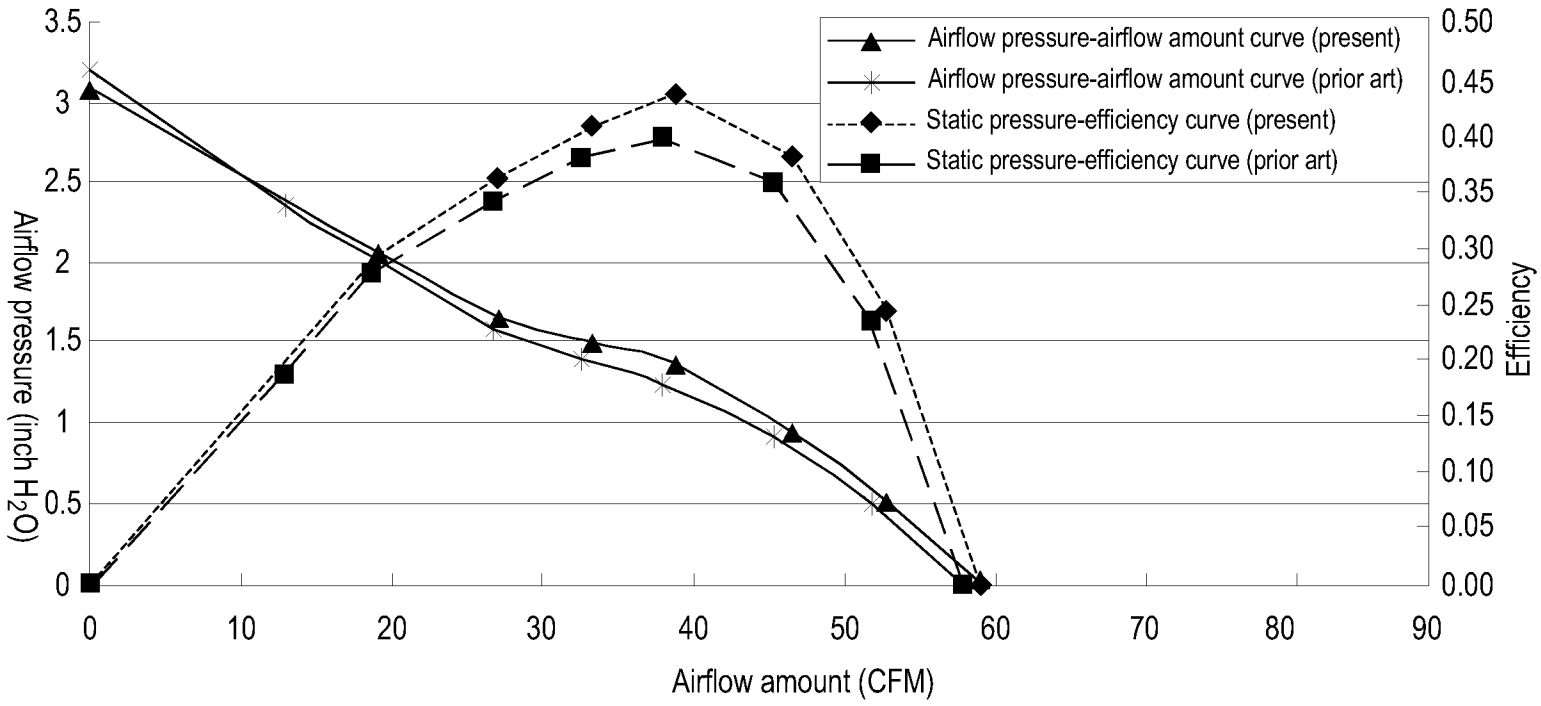
FIG. 3A is a schematic plot illustrating the relationship between the airflow amount, the airflow pressure and the efficiency of the impeller of FIG. 2A in comparison with the impeller of FIG. 1.

FIG. 3A is a schematic plot illustrating the relationship between the airflow amount, the airflow pressure and the efficiency of the impeller of FIG. 2A in comparison with the impeller of FIG. 1. As shown in FIG. 3A, the efficiency of the impeller 20 of the present invention is obviously higher than that of the conventional impeller. That is, the chamfered surface of the airflow-guiding part 232 is helpful for guiding the airflow from the first curvy surface 233 to the tip part 230 and stopping the leaked airflow of the second curvy surface 234. As a consequence, the efficiency of the impeller 20 of the present invention is enhanced.

Figure 3B:
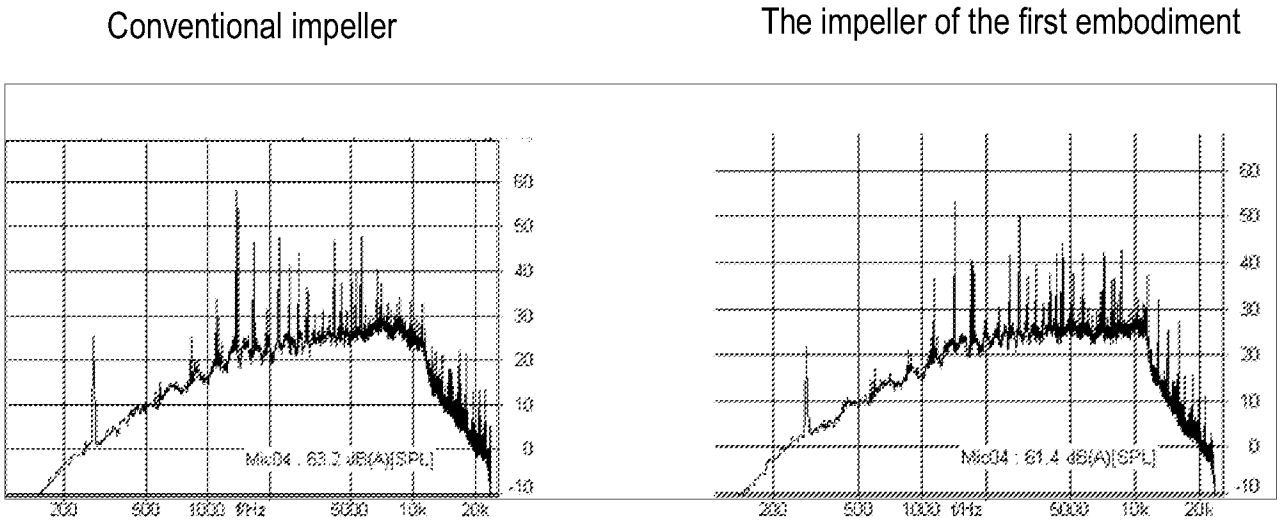
FIG. 3B is a schematic plot illustrating the noise (dB) of the impeller of FIG. 2A at different frequencies in comparison with the fan assembly of FIG. 1.

FIG. 3B is a schematic plot illustrating the noise (dB) of the impeller of FIG. 2A at different frequencies in comparison with the fan assembly of FIG. 1. As shown in FIG. 3B, the narrowband noise of the impeller 20 of the present invention is obviously reduced. In addition, the wideband noise of the impeller 20 of the present invention in the frequency range between 5 k and 10 k is also reduced. It is demonstrated that the noise of the impeller 20 of the present invention is lower than the conventional impeller by about 1.8 dB. That is, the impeller with the airflow-guiding part 232 has higher efficiency and lower noise.

Figure 4B:
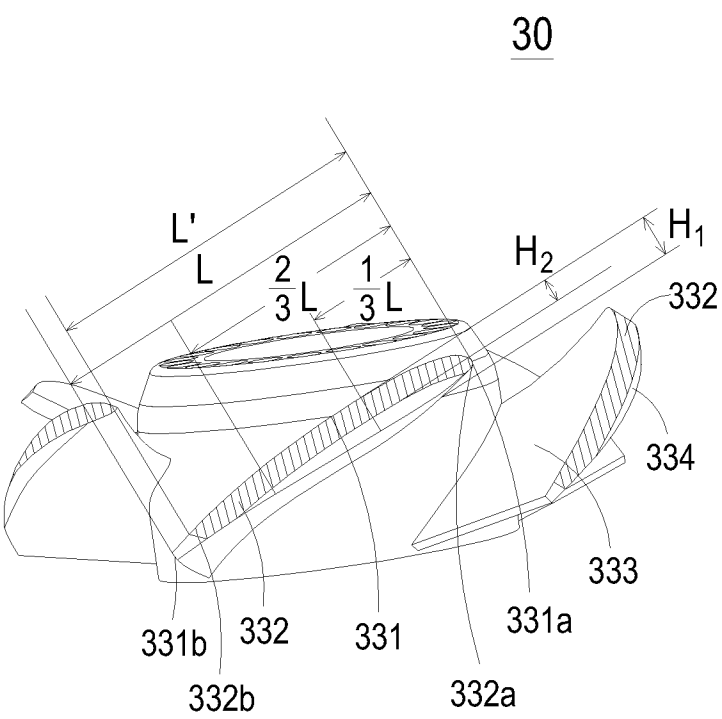
FIG. 4B is a schematic side view illustrating the impeller of FIG. 4A.
Figure 4A:
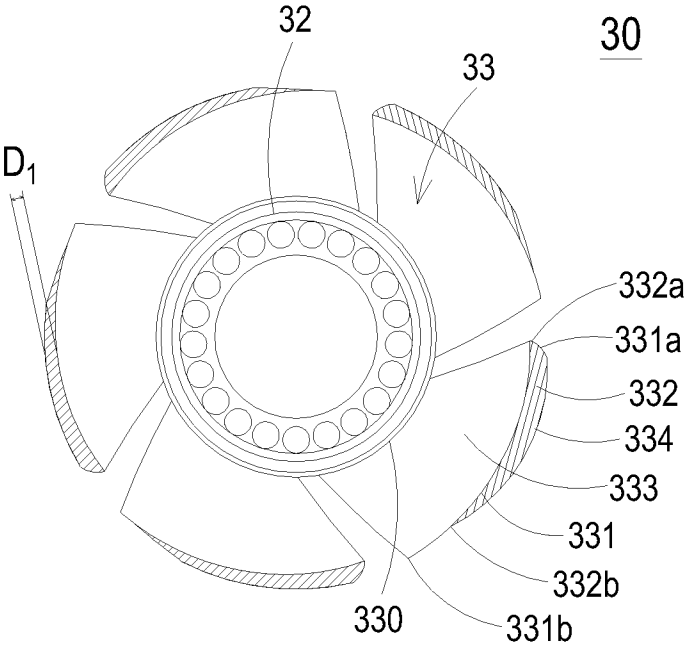
FIG. 4A is a schematic top view illustrating an impeller of a fan according to a second embodiment of the present invention.

FIG. 4A is a schematic top view illustrating an impeller of a fan according to a second embodiment of the present invention. As shown in FIG. 4A, the impeller 30 includes a hub 32 and a plurality of blades 33. A motor (not shown) is installed within the hub 32 for providing motive power requiring for operations of the fan. The blades 33 are arranged around the hub 32 and connected with the hub 32. As the hub 32 is driven to rotate by the motor, the blades 33 are synchronously rotated to produce airflow.

The blade 33 includes a first curvy surface 333, an edge surface 334, a base part 330 and a tip part 331. The base part 330 and the tip part 331 are arranged at opposed sides of the blade 33. In addition, the tip part 331 has an airflow-guiding part 332. The configurations of the first curvy surface 333, the base part 330 and the tip part 331 of the blade 33 are similar to those of the first embodiment, and are not redundantly described herein. In this embodiment, the airflow-guiding part 332 has a chamfered surface extended backwardly from the front end 331*a* of the tip part 331. The chamfered surface of the airflow-guiding part 332 is arranged beside the edge surface 334 and the first curvy surface 333. In addition, the chamfered surface is arranged between the first curvy surface 333 and the edge surface 334.

In some embodiments, the edge surface 334 and the first curvy surface 333 are perpendicular to each other. In addition, the airflow-guiding part 332 has a front guide terminal 332*a* and a rear guide terminal 332*b*. The front guide terminal 332*a* of the airflow-guiding part 332 is overlapped with the front end 331*a* of the tip part 331. Since the chamfered surface is not extended to the rear end 331*b* of the tip part 331, the rear guide terminal 332*b* of the airflow-guiding part 332 is not overlapped with the rear end 331*b* of the tip part 331. In other words, the rear guide terminal 332*b* of the airflow-guiding part 332 is separated from the rear end 331*b* of the tip part 231 by a distance.

FIG. 4B is a schematic side view illustrating the impeller of FIG. 4A. As shown in FIG. 4A, the depth H2 of the airflow-guiding part 332 is relatively shallower, and the length L' of the chamfered surface is shorter when compared with the tip part 331. Consequently, the rear guide terminal 332*b* of the airflow-guiding part 332 is separated from the rear end 331*b* of the tip part 331 by a distance. In this embodiment, the depth H2 of the airflow-guiding part 332 is constant. That is, the depth distribution of the airflow-guiding part 332 between the front guide terminal 332*a* and the rear guide terminal 332*b* is fixed. In some embodiments, the depth H2 of the airflow-guiding part 332 is varied as the thickness H1 of the blade 33 is changed. That is, the depth distribution of the airflow-guiding part 332 between the front guide terminal 332*a* and the rear guide terminal 332*b* is variable. For example, the depth of the front guide terminal 332*a* of the airflow-guiding part 332 is greater than the depth of the rear guide terminal 332*b* of the airflow-guiding part 332. The depth of the airflow-guiding part 332 may be varied according to the practical requirements.

Please refer to FIGS. 4A and 4B again. The width D1 of the airflow-guiding part 332 (i.e. the width of the chamfered surface) is changed as the chord length is varied. That is, the width of the front guide terminal 332*a* of the airflow-guiding part 332 is different from the width of the rear guide terminal 332*b* of the airflow-guiding part 332. In this embodiment, the width of the front guide terminal 332*a* of the airflow-guiding part 332 is greater than the width of the rear guide terminal 332*b* of the airflow-guiding part 332. In some embodiments, the width of the airflow-guiding part 332 is constant. It is noted that the length L' of the airflow-guiding part 332 and the start point and the final point of the chamfered surface are not restricted. In other words, it is not necessary that the front guide terminal 332*a* of the airflow-guiding part 332 is overlapped with the front end 331*a* of the tip part 331; and it is not necessary that the rear guide terminal 332*b* of the airflow-guiding part 332 is overlapped with the rear end 331*b* of the tip part 331.

In a preferred embodiment, assuming that the length of the tip part 331 is L, the distance between the front guide terminal 332*a* of the airflow-guiding part 332 and the front end 331*a* of the tip part 331 is ⅓L, and the distance between the rear guide terminal 332*b* of the airflow-guiding part 332 and the rear end 331*b* of the tip part 331 is ⅓L. That is, the airflow-guiding part 332 is arranged at the middle portion of the tip part 331, and the length of the airflow-guiding part 332 is at least ⅓L. Moreover, the airflow-guiding part 332 may be extended forwardly or backwardly from the middle portion of the tip part 331. It is preferred that the depth H2 of the airflow-guiding part 332 at ⅓L~⅔L with respect to the front end 331*a* of the tip part 331 is 3/10~1 time as large as the thickness H1 of the blade 33. Moreover, the width D1 of the airflow-guiding part 332 at ⅓L~⅔L with respect to the front end 331*a* of the tip part 331 is 4/10~1 time as large as the depth H2.

Figure 5:
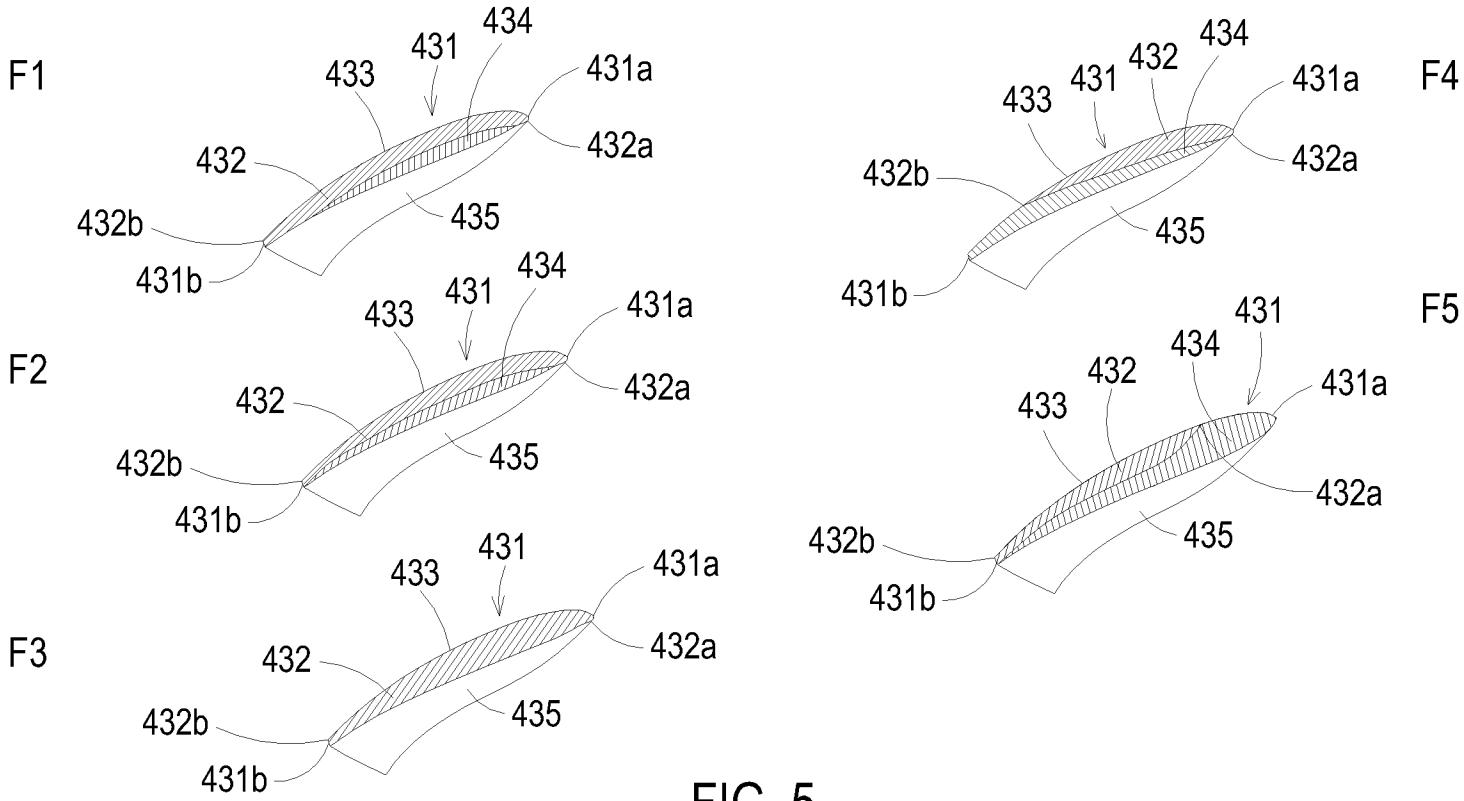
FIG. 5 schematically illustrates five variants of the blades of the impeller according to the present invention.

FIG. 5 schematically illustrates five variants of the blades of the impeller according to the present invention. Each blade 43 of five variants F1, F2, F3, F4 and F5 includes a tip part 431, an airflow-guiding part 432, a first curvy surface 433 and a second curvy surface 435. These blades 43 are somewhat distinguished. In the blades 43 of the variants F1, F2 and F3, the depths and the curvatures of the chamfered surfaces are different. In the blade 43 of the variant F1, the depth of the airflow-guiding part 432 is substantially constant. In the blade 43 of the variant F2, the depth of the front guide terminal 432*a* of the airflow-guiding part 432 is greater than the depth the rear guide terminal 432*b* of the airflow-guiding part 432. In the blade 43 of the variant F3, the depth of the chamfered surface is shallower and the rear guide terminal 432*b* of the airflow-guiding part 432 is overcut, so that the edge surface 434 of the blade 43 is cut off. That is, the airflow-guiding part 432 is directly arranged between the first curvy surface 433 and the second curvy surface 435.

Please refer to FIG. 5 again. In the blade 43 of the variant F4, the airflow-guiding part 432 has a chamfered surface extended backwardly from the front end 431*a* of the tip part 431. That is, the front guide terminal 432*a* of the airflow-guiding part 432 is overlapped with the front end 431*a* of the tip part 431. Since the chamfered surface is not extended to the rear end 431*b* of the tip part 431, the rear guide terminal 432*b* of the airflow-guiding part 432 is not overlapped with the rear end 431*b* of the tip part 431. In other words, the rear guide terminal 432*b* of the airflow-guiding part 432 is separated from the rear end 431*b* of the tip part 431 by a distance. In the blade 43 of the variant F5, the airflow-guiding part 432 has a chamfered surface extended backwardly from a middle position of the tip part 431. That is, the front guide terminal 432*a* of the airflow-guiding part 432 is not overlapped with the front end 431*a* of the tip part 431. In other words, the front guide terminal 432*a* of the airflow-guiding part 432 is separated from the front end 431*a* of the tip part 431 by a distance. In addition, the rear guide terminal 432*b* of the airflow-guiding part 432 is overlapped with the rear end 431*b* of the tip part 431. From FIG. 5, it is noted that numerous modifications of the airflow-guiding part 432 may be made while retaining the teachings of the invention. That is, the depth, width, curvature, start point and final point of the chamfered surface of the airflow-guiding part 432 may be varied according to the practical requirements as long as the thickness of the blade 43 is gradually increased from the base part to the tip part and the blade 41 is arranged between the first curvy surface 43 and the edge surface 434.

Figure 6B:
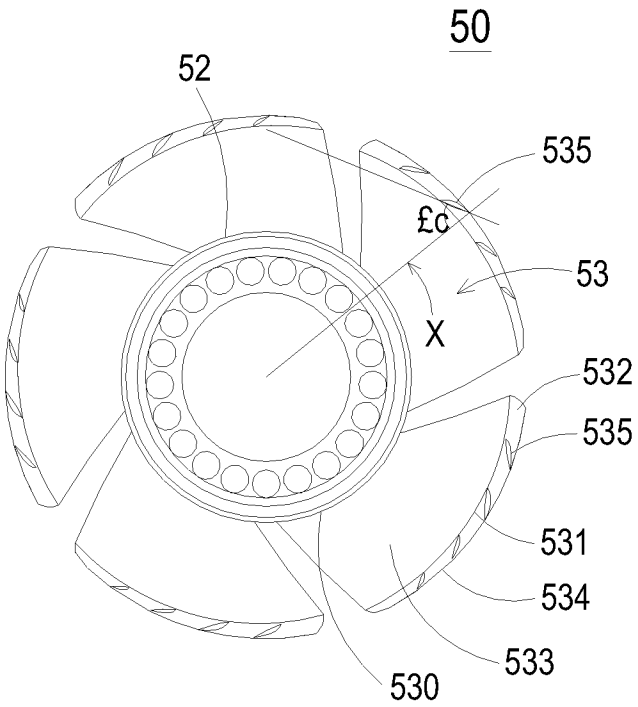
FIG. 6B is a schematic top view illustrating the impeller of FIG. 6A.
Figure 6A:
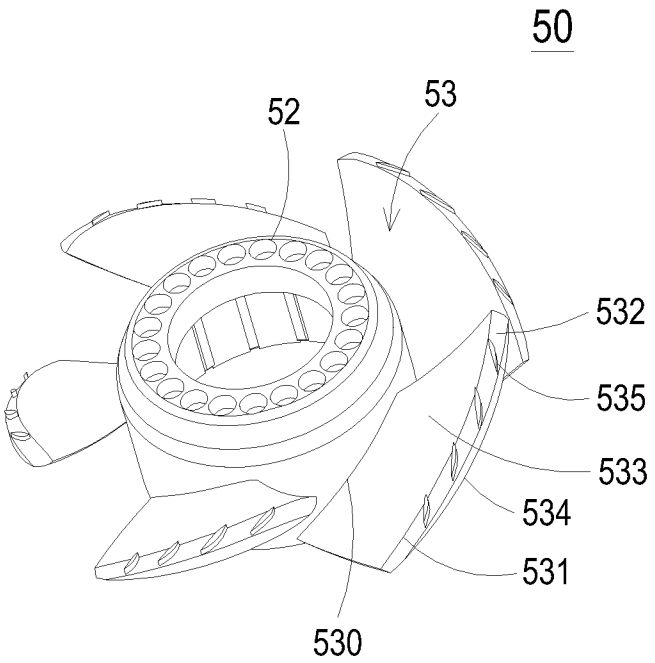
FIG. 6A is a schematic side view illustrating an impeller of a fan according to a third embodiment of the present invention.

FIG. 6A is a schematic side view illustrating an impeller of a fan according to a third embodiment of the present invention. As shown in FIG. 6A, the impeller 50 includes a hub 52 and a plurality of blades 53. The blades 53 are arranged around the hub 52 and connected with the hub 52. The blade 53 includes a first curvy surface 533, a second curvy surface 534, a base part 530 and a tip part 531. The base part 530 and the tip part 531 are arranged at opposed sides of the blade 53. In addition, an airflow-guiding part 532 is arranged between the first curvy surface 533 and the tip part 531. The configurations of the first curvy surface 533, the second curvy surface 534, the base part 530 and the tip part 531 of the blade 53 are similar to those of the first embodiment, and are not redundantly described herein. In this embodiment, the airflow-guiding part 532 further includes a plurality of auxiliary airflow-guiding structures 535. The auxiliary airflow-guiding structures 535 are protruded from the chamfered surface of the airflow-guiding part 532. In addition, the auxiliary airflow-guiding structures 535 are discretely arranged on the airflow-guiding part 532 at regular intervals and parallel with each other. The auxiliary airflow-guiding structures 535 are for example wing-shaped bulges or elongated bulges.

FIG. 6B is a schematic top view illustrating the impeller of FIG. 6A. A plurality of auxiliary airflow-guiding structures 535 are disposed on the airflow-guiding part 532 of the blade 53 for assisting in obliquely guiding the airflow from the first curvy surface 533 to the tip part 531 and stopping the leaked airflow of the second curvy surface 534. Consequently, the possibility of causing airflow leakage is reduced, the efficiency of the fan is enhanced, and the noise resulted from the impeller 50 is reduced. As shown in FIG. 6B, an extension line X passes through a center of the hub 52 and the auxiliary airflow-guiding structure 535. An included angle θ between the auxiliary airflow-guiding structure 535 and the extension line X is ranged between 30 and 120 degrees. It is noted that the number, shapes and locations of the auxiliary airflow-guiding structure 535 may be varied according to the practical requirements. The auxiliary airflow-guiding structure 535 are not restricted as long as they are helpful for assisting the impeller 50 to guide the airflow and prevent the airflow leakage through the clearance gap.

From the above description, the impeller of the present invention includes a hub and a plurality of blades arranged around the hub. The thickness of the blade is gradually increased from the base part to the tip part. The blade of the impeller has an airflow-guiding part for obliquely guiding the airflow from the first curvy surface to the tip part and stopping the leaked airflow of the second curvy surface. In such way, the problem of reducing the output static pressure of the fan will be minimized, the efficiency of the fan is enhanced, and the noise resulted from the impeller is reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An impeller of a fan, said impeller comprising:

a hub; and a plurality of blades connected with said hub, wherein each blade comprises a base part connected with said hub and a tip part opposed to said base part, wherein the thickness of said tip part of said blade is greater than that of said base part of said blade, an airflow-guiding part is disposed at said tip part of said blade, said airflow-guiding part has a front guiding terminal and a rear guiding terminal, and the depth of said front guiding terminal is greater than that of said rear guiding terminal, wherein said airflow-guiding part has a chamfered surface with a flat profile, a curvy profile or an arc-shaped profile.

2. The impeller according to claim 1, wherein said airflow-guiding part further comprises a plurality of auxiliary airflow-guiding structures, which are protruded from said chamfered surface, said auxiliary airflow-guiding structures are wing-shaped bulges or elongated bulges and are discretely arranged on said airflow-guiding part at regular intervals and parallel with each other, and an extension line passes through a center of said hub and said auxiliary airflow-guiding structure, wherein an included angle between said auxiliary airflow-guiding structure and said extension line is ranged between 30 and 120 degrees.

3. The impeller according to claim 1, wherein said blade further comprises an edge surface, which is disposed on said tip part and beside said chamfered surface, said blade comprises a first curvy surface at a first side thereof, and said chamfered surface is arranged between said first curvy surface and said edge surface, and said blade further comprises a second curvy surface at a second side thereof, wherein said first side and said second side are opposed to each other, and said edge surface is arranged between said chamfered surface and said second curvy surface, and said edge surface is perpendicular to said first curvy surface or said second curvy surface.

4. An impeller of a fan, said impeller comprising:

a hub; and a plurality of blades connected with said hub, wherein each blade comprises a base part connected with said hub and a tip part opposed to said base part, wherein the thickness of said tip part of said blade is greater than that of said base part of said blade, said tip part has a front end and a rear end, and an airflow-guiding part is disposed at said tip part of said blade, said airflow-guiding part has a front guiding terminal and a rear guiding terminal, wherein said front guiding terminal of said airflow-guiding part is overlapped with said front end of said tip part, and said rear guiding terminal is not overlapped with said rear end of said tip part, wherein said airflow-guiding part has a chamfered surface with a flat profile, a curvy profile or an arc-shaped profile.

5. The impeller according to claim 4, wherein said airflow-guiding part further comprises a plurality of auxiliary airflow-guiding structures, which are protruded from said chamfered surface, said auxiliary airflow-guiding structures are wing-shaped bulges or elongated bulges and are discretely arranged on said airflow-guiding part at regular intervals and parallel with each other, and an extension line passes through a center of said hub and said auxiliary airflow-guiding structure, wherein an included angle between said auxiliary airflow-guiding structure and said extension line is ranged between 30 and 120 degrees.

6. The impeller according to claim 4, wherein said blade further comprises an edge surface, which is disposed on said tip part and beside said chamfered surface, said blade comprises a first curvy surface at a first side thereof, and said chamfered surface is arranged between said first curvy surface and said edge surface, and said blade further comprises a second curvy surface at a second side thereof, wherein said first side and said second side are opposed to each other, and said edge surface is arranged between said chamfered surface and said second curvy surface, and said edge surface is perpendicular to said first curvy surface or said second curvy surface.

7. The impeller according to claim 1, wherein a distance between said rear guide terminal of said airflow-guiding part and said rear end of said tip part is equal to one third of the length of said tip part.

8. The impeller according to claim 1, wherein said blade comprises a first curvy surface at a first side and a second curvy surface at a second side, wherein said first side and said second side are opposed to each other, and said airflow-guiding part is arranged between said first curvy surface and said second curvy surface.

9. The impeller according to claim 1, wherein the depth of said airflow-guiding part at one third to two thirds of the length of said tip part with respect to an end of said tip part is 3/10~1 time as large as the thickness of said blade.

10. The impeller according to claim 1, wherein the length of said airflow-guiding part is at least one third of the length of said tip part.

11. The impeller according to claim 1, wherein the thickness of said tip part of said blade is at least 1.5 times as large as the thickness of said base part of said blade.

12. The impeller according to claim 1, wherein said airflow-guiding part is arranged at the middle portion of said tip part, and the length of said airflow-guiding part is 1/3 time as large as the length of said tip part.

13. The impeller according to claim 1, wherein the width of said airflow-guiding part at one third to two thirds of the length of said tip part with respect to an end of said tip part is 4/10~1 time as large as the depth of said airflow-guiding part.

14. The impeller according to claim 1, wherein the width of said airflow-guiding part is constant or the width of said airflow-guiding part is changed as a chord length of said blade is varied.

15. The impeller according to claim 4, wherein said blade comprises a first curvy surface at a first side and a second curvy surface at a second side, wherein said first side and said second side are opposed to each other, and said airflow-guiding part is arranged between said first curvy surface and said second curvy surface.

16. The impeller according to claim 4, wherein the depth of said airflow-guiding part at one third to two thirds of the length of said tip part with respect to an end of said tip part is 3/10~1 time as large as the thickness of said blade.

17. The impeller according to claim 4, wherein the length of said airflow-guiding part is at least one third of the length of said tip part.

18. The impeller according to claim 4, wherein the thickness of said tip part of said blade is at least 1.5 times as large as the thickness of said base part of said blade.

19. The impeller according to claim 4, wherein said airflow-guiding part is arranged at the middle portion of said tip part, and the length of said airflow-guiding part is 1/3 time as large as the length of said tip part.

20. The impeller according to claim 4, wherein the width of said airflow-guiding part at one third to two thirds of the length of said tip part with respect to an end of said tip part is 4/10~1 time as large as the depth of said airflow-guiding part.

21. The impeller according to claim 4, wherein the width of said airflow-guiding part is constant or the width of said airflow-guiding part is changed as a chord length of said blade is varied.

* * * * *